US009962977B2

(12) United States Patent
Kuschnitzky

(10) Patent No.: US 9,962,977 B2
(45) Date of Patent: May 8, 2018

(54) SYSTEMS AND METHODS FOR INLINE DIGITAL PRINTING

(71) Applicant: Innovative Printing Technologies, Inc., Sarasota, FL (US)

(72) Inventor: Peter Kuschnitzky, Sarasota, FL (US)

(73) Assignee: Innovative Printing Technologies, Inc., Sarasota, FL (US)

( * ) Notice: Subject to any disclaimer, the term of this patent is extended or adjusted under 35 U.S.C. 154(b) by 0 days. days.

(21) Appl. No.: 15/481,886

(22) Filed: Apr. 7, 2017

(65) Prior Publication Data

US 2017/0291430 A1 Oct. 12, 2017

Related U.S. Application Data

(60) Provisional application No. 62/319,577, filed on Apr. 7, 2016.

(51) Int. Cl.

| | |
|---|---|
| ***B41M 5/00*** | (2006.01) |
| ***B41J 3/407*** | (2006.01) |
| ***B41J 3/54*** | (2006.01) |
| *B41M 1/26* | (2006.01) |
| *B41M 1/28* | (2006.01) |
| *B41M 1/30* | (2006.01) |
| *B41M 5/50* | (2006.01) |

(52) U.S. Cl.

CPC ..... *B41M 5/0041* (2013.01); *B41J 3/4075* (2013.01); *B41J 3/546* (2013.01); *B41M 1/26* (2013.01); *B41M 1/28* (2013.01); *B41M 1/30* (2013.01); *B41M 5/0047* (2013.01); *B41M 5/0058* (2013.01); *B41M 5/0064* (2013.01); *B41M 5/508* (2013.01)

(58) Field of Classification Search

CPC ..... B41M 5/0041; G41J 3/4075; G41J 3/546; B41J 11/002; B41J 11/0015; B41J 2/2114

See application file for complete search history.

(56) References Cited

U.S. PATENT DOCUMENTS

| | | | |
|---|---|---|---|
| 6,927,014 | B1 | 8/2005 | Figov |
| 7,275,818 | B2 | 10/2007 | Figov et al. |
| 2004/0101671 | A1 | 5/2004 | Rathschlag |
| 2009/0256897 | A1 | 10/2009 | Polk et al. |

(Continued)

FOREIGN PATENT DOCUMENTS

| | | | |
|---|---|---|---|
| WO | 2010092392 | A1 | 8/2010 |
| WO | 2014187714 | A1 | 11/2014 |

OTHER PUBLICATIONS

"UV Coating Advantages for Printing" http://www.printingforless.com/UV-Coatings-For-Printing.html Accessed Date: Mar. 2016.

*Primary Examiner* — Juanita D Jackson

(74) *Attorney, Agent, or Firm* — Dinsmore & Shohl LLP

(57) ABSTRACT

An inline printing system comprising: a substrate feeder; an adhesive application station in communication with the substrate feeder and configured to coat a UV adhesive onto the substrate; a pressing station in communication with the adhesive application station and configured to apply laminate to the coated substrate; a UV curing station in communication with the pressing station and configured to cure the laminated substrate coated with the UV adhesive; and a digital print station in communication with the pressing station and configured to print on the laminated substrate.

16 Claims, 2 Drawing Sheets

(56) References Cited

U.S. PATENT DOCUMENTS

| | | | | |
|---|---|---|---|---|
| 2010/0013880 | A1 | 1/2010 | Polk et al. | |
| 2010/0186610 | A1 | 7/2010 | Polk et al. | |
| 2011/0254909 | A1 | 10/2011 | Lu | |
| 2013/0101809 | A1 | 4/2013 | Kohlweyer et al. | |
| 2014/0028772 | A1* | 1/2014 | Pervan | B41J 2/485 347/110 |
| 2014/0098167 | A1 | 4/2014 | Bernard et al. | |
| 2015/0030823 | A1 | 1/2015 | Stamatoukos et al. | |

* cited by examiner

SYSTEMS AND METHODS FOR INLINE DIGITAL PRINTING

CROSS-REFERENCE TO RELATED APPLICATIONS

This application claims priority to U.S. Provisional Patent Application Ser. No. 62/319,577 filed Apr. 7, 2016, which is incorporated by reference herein in its entirety.

TECHNICAL FIELD

Embodiments of the present disclosure generally relate to digital printing, specifically systems and methods to digitally print inline using an inkjet printer.

BACKGROUND

In the past 15 years, advancements in digital printing field have made digital printing in a commercial setting possible. Digital printing can be faster and more cost effective than traditional offset printing. Using in-line digital printing, for example the MEMJET® aqueous dye technology, manufacturers increase the digital printing speed of production and resolutions of the products. A drawback to this technology is the price of the material needed for this digital process. To print correctly, the substrate may be microporous or have a microporous or swellable inkjet receptive coating. This coating helps the ink dry, brings the color brilliance to the surface, and may enhance the water resilience.

SUMMARY

Normal labeling stock (material that is not inkjet receptive) on average is approximately 40% of the cost to produce labels. In order for the labeling material to be inkjet receptive, the cost of labeling material is 3 to 5 times greater than regular labeling stock.

Many coating companies have tried without success to invent a coating which can be applied by an inline printing process upstream from a digital printing system. Approximately 15 to 20 grams or more of dry weight must be applied to the labeling material or substrate. However, the inkjet coating required for digital printing is primarily water or liquid, and in most cases the coating only contains 20% to 30% solid. To dry the coating, large drying tunnels are needed that are equipped with forced hot air or infrared (IR) heaters. These drying tunnels are can be more than 60 feet long and cannot fit into an inline process on a printing press. The cost of such dryers is prohibitive.

Ongoing needs exist to produce an inline print system that incorporates the inkjet receptive coating. By pressing a substrate with an adhesive coating and a laminate with an inkjet receptive coating all inline, an inline printing system becomes more cost effective and more versatile.

Embodiments of this disclosure include an inline printing system including a substrate feeder, an adhesive application station in communication with the substrate feeder and configured to coat an adhesive onto the substrate to form a coated substrate, a pressing station in communication with the adhesive application station and configured to apply an inkjet receptive laminate to the coated substrate, a curing station in communication with the pressing station and configured to cure the laminated substrate coated with the adhesive to form a multilayered substrate, wherein the multilayered substrate is inkjet receptive, and a digital print station in communication with the pressing station and configured to print on the multilayered substrate.

Another embodiment in this disclosure is a method of inline digitally printing comprising the steps of coating a substrate printing material with a wet UV curable adhesive, then applying lamination to the substrate material coated with wet UV curable adhesive, followed by curing the laminated substrate with UV radiation, and finally printing on the multilayered substrate to produce a digital printed image.

Figure 1:
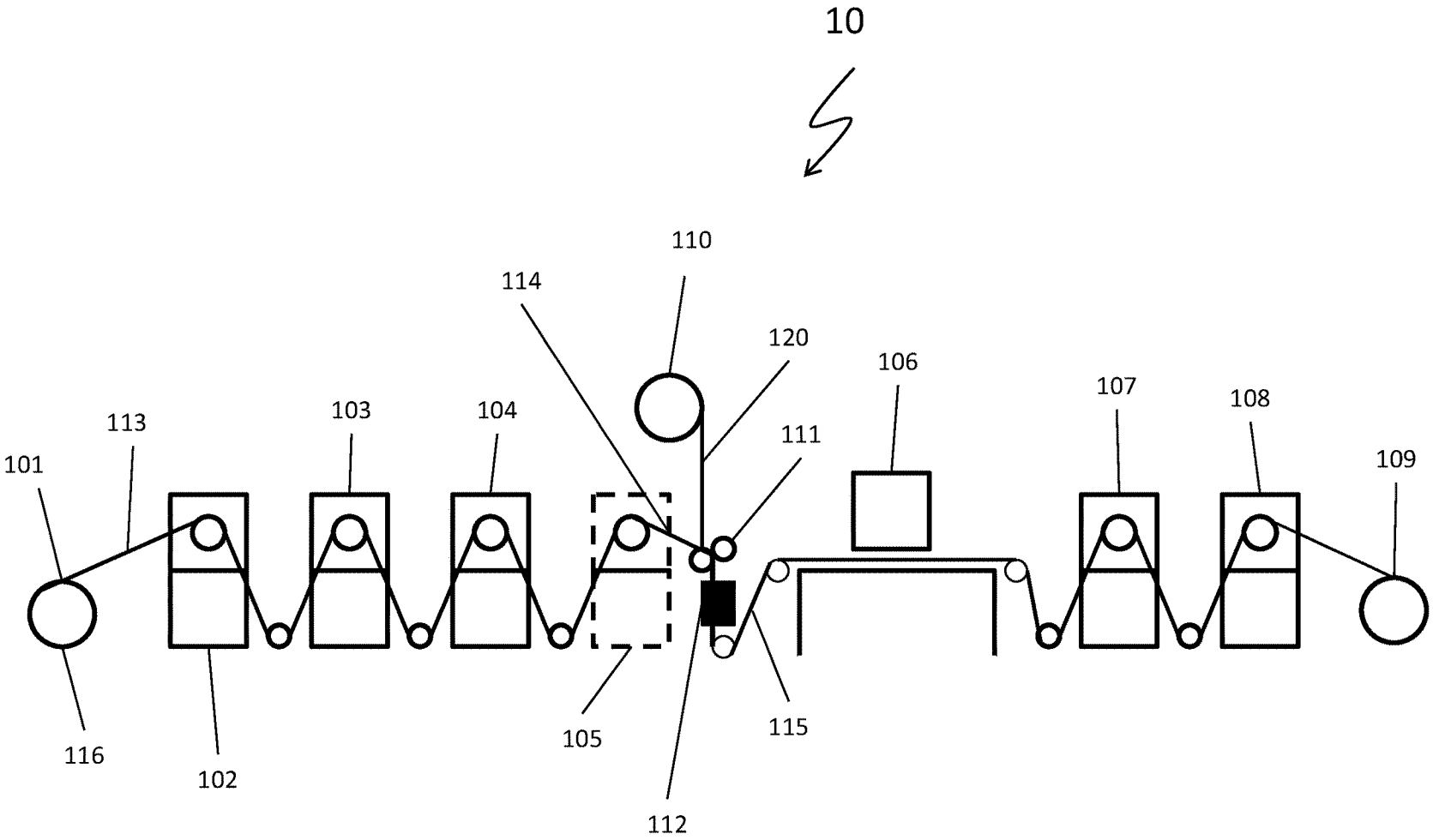
FIG. 1 depicts a print system using a UV curing process before the digital printing occurs.

The embodiments set forth in the drawings are illustrative in nature and not intended to be limiting to the claims. Moreover, individual features of the drawings will be more fully apparent and understood in view of the detailed description.

DETAILED DESCRIPTION

Specific embodiments of the present application will now be described. The invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art. The terminology used in the description herein is for describing particular embodiments only and is not intended to be limiting. As used in the specification and appended claims, the singular forms "a," "an," and "the" are intended to include the plural forms as well, unless the context clearly indicates otherwise.

For the purpose of this disclosure, "stream" means the process by which the substrate is fed from station to station. "Upstream" is a directional indication of the location of a station the preceded the correlating station. "Downstream" is a directional indication of the location of a station occurs later in the sequence. In addition, for the purpose of this disclosure, "in communication with" indicates a path or means by which the substrate is fed, processed or travels from station to station.

Referring to FIG. 1, one embodiment of the inline printing system 10 is depicted. The inline printing system 10 comprises a substrate feeder 101, an adhesive application station 105, a pressing station 111, a curing station 112, and a digital print station 106.

In one or more embodiments, the substrate feeder 101 can be an unwind unit, a track feeder, a friction feeder, a sheet separation unit for individual sheets of paper, a stream feeder, a single sheet feeder, or a sheet controller system. Additionally, the substrate feeder may include various components, such as a feed roller. The substrate feeder 101 transfers the substrate 113 that will be printed on through the various stations of the inline printing system 10.

In some embodiments, the substrate 113 is rolled, uncut labeling material, which when fed through the inline printing system 10 is printed, then cut into appropriate size labels. Though in other embodiments, the substrate 113 can be any surface to which a wet UV curable adhesive can adhere. The substrate 113 is typically paper material, for example labeling material, but it can also be plastics, foil, metal, cloth, or any other surface to which printing ink is applied. In some embodiments, the plastic may include biaxially-oriented polypropylene (BOPP) or biaxially-oriented polyethylene terephthalate (BOPET).

In some embodiments of the inline printing system 10, the substrate 113 is fed from the substrate feeder 101 to the first print station 102. However, in other embodiments, there may be an unwind station 116 in conjunction with the substrate feeder 101. The substrate 113 is then fed to two additional print stations, 103 and 104. FIG. 1 depicts three normal print stations, 102, 103 and 104, but that depiction is not intended to be limiting. There can be as few as zero print stations or more than ten print stations.

The additional print stations, 102, 103 and 104, represent typical printing stations to which the digital printer would attach. These stations would print flexographically, letter press screen, offset, gravure, or other types of printing processes. As mentioned in the prior paragraph, in some embodiments, there are as many as ten and as few as zero different print stations. In one embodiment, print station 102 is a flexographic (flexo) print system. The flexo printer station 102 prints white ink onto substrate 113, which can be clear, translucent, silver, gold or opaque substrates. As the inline printing system 10 circulates the substrate 113 through the print stations 102, 103, or 104 non-digital ink, white ink, or a combination thereof may be printed on the substrate 113. After the substrate 113 is processed through the print stations 102, 103, and 104, it is fed into the adhesive application station 105.

The adhesive application station 105 may include a bath, a spray nozzle, flexo, letterpress, screen printing, offset or some other coating application. The adhesive application station 105 applies a wet adhesive onto the substrate 113, and substrate 113 becomes coated substrate 114. In some embodiments, the wet adhesive is a UV curable adhesive, and when the UV curable adhesive is applied to a substrate, a UV curable substrate is formed.

"Wet bond lamination" or a "wet adhesive" is a laminating process used to laminate two substrates. Once the wet bonding process is applied to a substrate, the two substrates will then be combined prior to passing through a drying or a curing station. This drying or a curing process is where the adhesive materials will dry or cure, essentially adhering the two substrates together, therefore, the two substrates need to be combined before the adhesive is passed through a drying or a curing station.

Once the substrate 113 is coated with the UV curable adhesive, an inkjet receptive laminate 120 is applied to the coated substrate 114. The coated substrate 114 and the inkjet receptive laminate 120 are pressed at the pressing station 111 and immediately passed through a curing station 112.

In one or more embodiment, the curing station 112 is a UV curing station. The UV curing station may include a UV lamp, but any ultraviolet light emitting source or form of electromagnetic radiation is a possible alternative.

Once the inkjet receptive laminate 120 is applied to a substrate, the substrate becomes inkjet receptive, thus producing a wide array of inkjet receptive material. In order for a substrate to be "inkjet receptive," the substrate comprises a microporous surface or swellable inkjet receptive coating. A laminate is coated with an inkjet receptive coating using a special coating machine, and dried off-site. Applying this laminate to the substrate allows any substrate to become inkjet receptive. The laminate is applied upstream from the digital print station in an inline process. This decreases manufacturers costs, since they no longer have to supply different sizes or types of expensive substrates or labeling material and expands the types of substrates, on which can be digitally printed.

Another embodiment of the inline printing system 10, as seen in FIG. 1, includes a laminate unwind station 110, which can be located near the adhesive application station 105, and the inkjet receptive laminate 120 is unwound and fed into the stream of the inline printing system 10. Though the laminate unwind station 110 should not be limited by location, the inkjet receptive laminate 120 must enter the stream after the adhesive application station 105 applies the adhesive coating and before the substrate passes through the pressing station 111 and before the substrate is cured at the curing station 112.

In one embodiment, the pressing station 111 is a nip station. However, a possible embodiment of the pressing station 111 may not include a physical station, but rather a point at which the inkjet receptive laminate 120 comes into contact with and adheres to the coated substrate 114.

After the coated substrate 114 passes through the curing station 112, it is able to hold digital ink and is called a multilayered substrate 115. As used in this disclosure, "multilayered substrate" means the post-curing product of the coated substrate 114 and inkjet receptive laminate 120. The multilayered substrate 115 is a sandwich-like structure where the UV curable adhesive is between the substrate 113 and the inkjet receptive laminate 120. The multilayered substrate 115 is fed to the digital print station 106. The digital print station 106 prints onto the multilayered substrate 115.

The digital print station 106 comprises a digital inkjet printer. In one embodiment, the inkjet printer is a MEMJET®. The MEMJET® has color printheads and uses technology that allows 70,400 jets per printhead to shoot millions of ink drops per second. The printer or printhead is controlled with a processor chip. Though MEMJET® is used to represent a working example; the inline printing system 10 is not limited to MEMJET® and encompasses other digital printers as a possible embodiment of the digital inkjet printer.

Without being bound by theory, the inline printing system 10 allows printing on white opaque ink. The flexo white ink (screen white or ink applied through non-digital methods) did not have the desire microporous characteristics needed to accept inkjet ink. By applying the inkjet receptive laminate 120, which has the inkjet receptive coating and is clear, the inline printing system 10 allows the digital printer to print over the white ink. Using white ink may enhance the digital ink, which is more translucent if it is not printed over white. Additionally, some labeling companies may want to apply white ink to a clear, translucent, or metalized substrate material.

In some embodiments, the multilayered substrate is then wound onto a rewind unit 109. Rewinding procedures include such operations as slitting machine rolls to make rolls having a specified width and diameter, winding on specially-constructed cores, removing the substrate or paper containing defects and splicing rolls back together, and packaging rolls for delivery.

Some embodiments include the system mentioned in the preceding paragraphs and additional print stations following the digital print station 106. In FIG. 1, there are two additional print stations, 107 and 108, but this is not intended to be limiting. There can be zero print stations or as many as ten additional print stations, which can varnish, trim, or otherwise tailor the substrate to the desired finished product.

Figure 2:
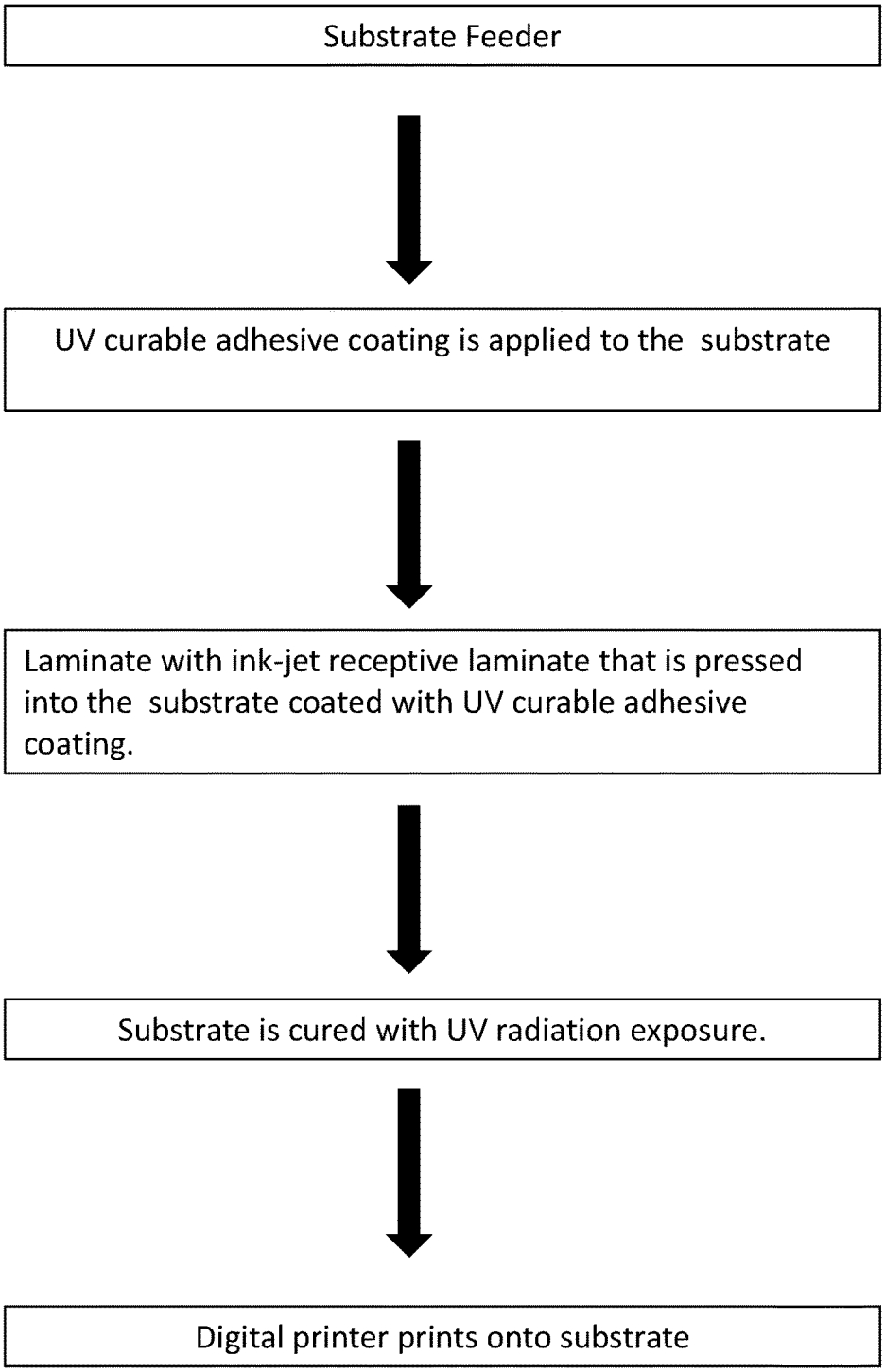
FIG. 2 illustrates a flow chart describing the process by which a digital print can be produced inline.

FIG. 2 illustrates the flow by which a substrate travels in the stream of the inline printing system. The substrate is feed into the printing stream by a substrate feeder, is coated with a UV curable adhesive coating, laminated with an inkjet receptive laminate, cured with UV radiation, and printed with a digital printer.

I claim:

1. An inline printing system comprising:

a substrate feeder;

an adhesive application station in communication with the substrate feeder and configured to coat an adhesive onto a substrate to form a coated substrate;

a pressing station in communication with the adhesive application station and configured to apply an inkjet receptive laminate onto the coated substrate;

a curing station in communication with the pressing station and configured to cure the laminated substrate coated with the adhesive to form a multilayered substrate, wherein the multilayered substrate is inkjet receptive; and a digital print station in communication with the pressing station and configured to print on the multilayered substrate.

2. The inline printing system according to claim 1, wherein the adhesive is a UV adhesive, and the curing station is a UV curing station.

3. The inline printing system according to claim 1, wherein the print station comprises an inkjet printer or other digital print system.

4. The inline printing system according to claim 1, wherein the print station comprises an inkjet printer having a processing chip.

5. The inline printing system according to claim 1 further comprising an unwinding station upstream from or in conjunction with the substrate feeder.

6. The inline printing system according to claim 1 further comprising 0 to 1 or more additional printing station, downstream from the digital print station.

7. The inline printing system according to claim 1, wherein the additional printing station is a flexographic printer, offset, or gravure.

8. The inline printing system according to claim 1 further comprising a laminate unwind station, upstream from the pressing station.

9. The inline printing system according to claim 1, wherein the pressing station is a nip station.

10. The inline printing system according to claim 1 further comprising 0 to 1 or more additional printing station, upstream from the digital print station.

11. The inline printing system according to claim 1, wherein the additional printing station is configured to varnish, trim, or otherwise finish the printed laminated substrate.

12. The inline printing system according to claim 1 further comprising a rewinding unit downstream of the digital print station.

13. A method of inline digital printing comprising the steps of:

coating a substrate printing material with a wet UV curable adhesive;

applying inkjet receptive lamination to the substrate material coated with wet UV curable adhesive to produce a multilayered substrate;

curing the multilayered substrate with UV radiation; and printing on the multilayered substrate to produce a digital print.

14. The method of inline digital printing according to claim 13, wherein a nip station presses the wet substrate printing material and inkjet receptive lamination to form the multilayered substrate, wherein the multilayered substrate is inkjet receptive.

15. The method of inline digital printing according to claim 13, wherein substrate printing material comprises paper, plastic, metal, foil, or cloth.

16. The method of inline digital printing according to claim 15, wherein the plastic is chosen from biaxially-oriented polypropylene (BOPP) or biaxially-oriented polyethylene terephthalate (BOPET).

* * * * *